US005851069A

United States Patent [19]

Davoren

[11] Patent Number: 5,851,069

[45] Date of Patent: Dec. 22, 1998

[54] MULTIPLE COMPARTMENT BAGS

[76] Inventor: Gerard A. Davoren, 3217 Tania Crescent, Burington Ontario, Canada, L7M 3N3

[21] Appl. No.: 907,956

[22] Filed: Aug. 11, 1997

Related U.S. Application Data

[63] Continuation-in-part of Ser. No. 584,455, Jan. 11, 1996, abandoned.

[51] Int. Cl.[6] ..... B65D 30/22

[52] U.S. Cl. ..... 383/38; 383/40; 383/87; 229/72

[58] Field of Search ..... 383/87, 38, 39, 383/40; 229/72

[56] References Cited

U.S. PATENT DOCUMENTS

| | | | |
|---|---|---|---|
| 1,681,922 | 8/1928 | Boch | 383/39 |
| 3,147,789 | 9/1964 | Paulson | 383/87 X |
| 3,217,934 | 11/1965 | Schneider et al. | 383/40 X |
| 3,446,421 | 5/1969 | Carrigan et al. | 229/72 |
| 3,485,697 | 12/1969 | Reed | 383/40 X |
| 3,680,768 | 8/1972 | Warren | 383/40 |
| 4,153,091 | 5/1979 | Jahn | 383/40 X |
| 4,388,958 | 6/1983 | Dworkin | 383/39 X |
| 4,648,860 | 3/1987 | Cassey | 383/40 X |
| 5,149,202 | 9/1992 | Dickert | 383/39 X |

FOREIGN PATENT DOCUMENTS

| | | | |
|---|---|---|---|
| 5330563 | 12/1993 | Japan | 383/87 |

*Primary Examiner*—Jes F. Pascua
*Attorney, Agent, or Firm*—McConnell and Fox

[57] ABSTRACT

A multiple compartment bag comprises a backing sheet and a cover sheet forming a first compartment open at its top end. A second compartment, usually shorter, is formed by a compartment forming sheet and a closure sheet overlying the cover sheet and one another, these smaller sheets being sealed at their edges to the edges of the two larger sheets to maximize the width of the compartment. The second compartment opening is labyrinthine, formed by the overlap between the compartment forming sheet top portion and the overlying closure sheet bottom portion. The length of the overlap is at least 30% of the total length of the second compartment, as compared to 10% in a prior proposal, and preferably is not more than 70%, thus ensuring safe retention of a bulky article in the second compartment while providing for ease of its insertion and its subsequent easy removal by the recipient. Such a bag is especially suited to package a large flat article, such as a newspaper, in the first compartment, and a smaller but bulkier article, such as a sample cereal box, in the second compartment. The bags are especially adapted for ready hand insertion of the articles into their respective compartments by distribution personnel in the field of advertising sample distribution from bulk supplies of the bags, publications and articles. The invention also provides inexpensive methods of making such multiple compartment bags.

14 Claims, 2 Drawing Sheets

MULTIPLE COMPARTMENT BAGS

CROSS-REFERENCE TO RELATED APPLICATION

This application is a continuation-in-part of my prior application Ser. No. 08/584,455, filed Jan. 11, 1996, now abandoned.

FIELD OF THE INVENTION

The present invention is concerned with new multiple compartment bags, and especially with new two compartment bags adapted to receive a relatively large flat article, such as a newspaper, in one compartment, and a smaller but more bulky article, such as a box sample, in the other compartment. The invention is concerned particularly to provide such new multiple compartment bags that are economical to manufacture, that are suitable for mass production, that facilitate manual insertion of the articles into the compartments such as by a person charged with distribution of the filled bags, and that ensure secure retention of the articles in the compartments, particularly of the bulky article in the other compartment.

REVIEW OF THE PROBLEM AND THE PRIOR ART

It is common in the field of periodical publications, such as newspapers and magazines, to enclose each issue in a wrapper, usually of a waterproof transparent plastics material, that will protect it against rough handling and weather. Such periodicals have always relied heavily upon their advertising content within the publication for their revenue, but increasingly advertisers are using separate multi-colour flyers which are included with the publication, so as to make use of the extensive, well-established, targeted, distribution system that is an essential part of the periodical publishing industry.

Manufacturers of various domestic products have always found a particularly effective form of advertising to be the distribution of samples to the intended users, and businesses are available which will make such deliveries. It is usually preferred that the sample be accompanied by an advertising flyer of some kind, and this presents a problem of keeping each sample and its accompanying flyer as an easily handled deliverable unit. Increasingly periodical publishers have seen this sample delivery field as one in which they can make use of their existing delivery network, and most of them already have systems in place for bagging the periodical as and when needed. However, these periodical bagging systems are unable to handle a sample consisting of a small but relatively bulky package of very different shape from the newspaper or magazine, such as a rectangular carton containing a tube of toothpaste or a cereal. Two compartment, or even multiple compartment, bags and pouches have been proposed hitherto, but there still exists a need for an inexpensive multiple compartment bag, particularly a two compartment bag, especially suited for this type of application.

For example, U.S. Pat. No. 4,256,256 discloses a pouch for packaging food which includes at least two different segregated compartments, the two pouches being formed simultaneously and the top edges of the two compartments being sealed together to form a single dual compartment package. U.S. Pat. No. 4,744,673 discloses a packaging bag intended to receive relatively inexpensive articles, the bag having on its sides open-ended secondary storing chambers intended to receive pamphlets of goods, a description of the article, a business card, etc. U.K Patent Publication No 2,066,209, published Jul. 08, 1981, discloses a bag intended to receive a container, e.g. for a sample and a form on which information about the sample is recorded, the pocket for the sample being closed using a fold-over flap, while the other employs a line of adhesive.

Japanese Publication No. 5-330563(A), published 14 Dec. 1992, of Matsushita K.K., discloses a packing bag consisting of a bag body where goods are packed and a pocket of smaller width and height sealed at its edges to the bag body and in which an invoice is placed; the smaller pocket is formed from two sheets, one shorter than the other, the top end of the longer sheet being overlapped over the top end of the shorter sheet to provide a narrow overlap W that is shown as about 10% of the length of the pocket. U.S. Pat. No. 4,648,860 of Cassey discloses an envelope, such as is used for courier services, having an integrally formed external pouch on one side for accommodating the accompanying despatch note, waybill or like, both the envelope and the pouch having their openings closed by adhesive seals. U.S. Pat. No. 3,680,768 to Warren discloses a plastic bag provided on one side with a pouch formed from a plastic layer heat sealed to the bag side, the pouch having spaced confronting folded-over edges and being intended to receive an indicia bearing card or sheet capable of being retained by he spaced folded-over ends.

DEFINITION OF THE INVENTION

The principal object of the invention is to provide new multiple compartment bags especially suited for the reception and secure retention of a relatively large flat article in one compartment, and a smaller more bulky article in another compartment.

It is another object to provide new methods of making such multiple compartment bags inexpensively to facilitate their adoption in the field of advertising sample distribution.

It is a further object to provide such multiple compartment bags that are especially adapted for manual insertion of the articles to be bagged into their respective compartments, such as by a person charged with the distribution of the filled bags.

In accordance with the present invention there is provided a multiple compartment bag comprising:

- a first backing sheet part having top, bottom and side edges;
- a second cover sheet part having top, bottom and side edges overlying the first sheet part with its bottom and side edges registering with the corresponding bottom and side edges of the first sheet part;
- a third compartment forming sheet part having top, bottom and side edges, of shorter length than the second sheet part, and overlying the second sheet part, with its side edges registering with the corresponding side edges of the second sheet part;
- a fourth closure sheet part having top, bottom and side edges, of shorter length than the second sheet part, overlying the second sheet part and overlying to a substantial depth the top edge and an immediately adjacent top portion of the third sheet part, with its side edges registering with the corresponding side edges of the second and third sheet parts;
- a fifth connecting sheet part having top, bottom and side edges and of shorter length than the second sheet part, connected at its top and bottom edges to the third and fourth sheet parts to connect the two parts together, and extending parallel to the adjacent portion of the second sheet part with its side edges registering with the corresponding side edges of the second, third and fourth sheet parts;

all of the registering side edges being sealed together to form a first compartment for reception and retention of a relatively large flat first article between the first and second sheet parts having an opening to its interior at its top end, and to form a second compartment for reception and retention of a relatively smaller bulky second article between the third, fourth and fifth sheet parts, the second compartment having a labyrinthine opening for insertion of the second article into its interior between the fourth sheet part bottom edge and the overlaid third sheet part top edge portion;

and wherein the length of the immediately adjacent top portion of the third sheet part overlaid by the fourth closure sheet part is between 30% and 70% of the total length of the second compartment, whereby the labyrinthine opening remains sufficiently closed to retain the bulky second article in the second compartment with extensive bulging of the second compartment by the article therein.

Bags of the invention may comprise further compartments similar to the second compartment.

Also in accordance with the present invention there is provided a method of making a multiple compartment bag comprising:

providing a first backing sheet part having top, bottom and side edges and a second cover sheet part having top, bottom and side edges with the bottom and side edges of the two sheet parts registering with one another;

providing a third compartment forming sheet part having top, bottom and side edges, of shorter length than the second sheet part, and overlying the second sheet part, with its side edges registering with the corresponding edges of the second sheet part, and a fourth closure sheet part having top, bottom and side edges, of shorter length than the cover sheet part, overlying the second sheet part and overlying to a substantial depth the top edge and an immediately adjacent top portion of the third sheet part, with its side edges registering with the corresponding edges of the second and third sheet parts and a fifth connecting sheet part having top, bottom and side edges and of shorter length than the second sheet part, connected at its top and bottom edges to the third and fourth sheet parts to connect the two parts together, and extending parallel to the adjacent portion of the second sheet part with its side edges registering with the corresponding edges of the second, third and fourth sheet parts; and sealing together all of the registering side edges, thereby forming a first compartment for reception and retention of a relatively large flat first article between the first and second sheet parts which has an opening to its interior at its top end, and a second compartment for reception and retention of a relatively smaller bulky second article between the third, fourth and fifth sheet parts, the second compartment having a labyrinthine opening for insertion of the second article into its interior between the fourth sheet part bottom edge and the overlaid third sheet part top edge portion;

wherein the length of the immediately adjacent top portion of the third sheet part overlaid by the fourth closure sheet part is between 30% and 70% of the total length of the second compartment, whereby the labyrinthine opening remains sufficiently closed to retain the bulky second article in the second compartment with extensive bulging of the second compartment by the article therein.

Preferably the sheets comprise continuous strips and separate multiple compartment bags are severed from the overlaid strips subsequent to the sealing together of the sheet part edges.

DESCRIPTION OF THE DRAWINGS

Multiple compartment bags, and methods of making such bags, that are particular preferred embodiments of the invention will now be described, by way of example, with reference to the accompanying diagrammatic drawings wherein.

In the Figures the thicknesses and spacing of the sheets of material are exaggerated where necessary for clarity of illustration.

DESCRIPTION OF THE PREFERRED EMBODIMENTS

Figure 1:
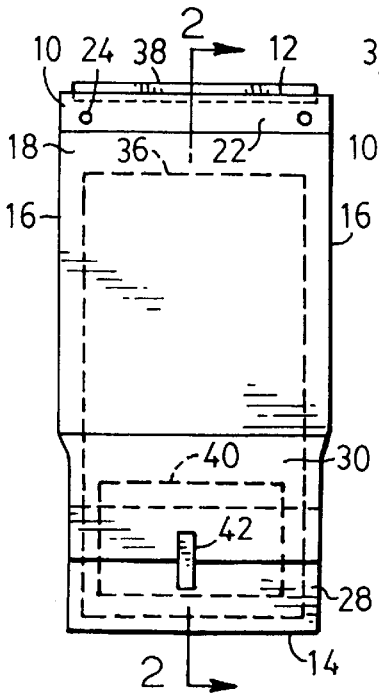
FIG. 1 is a front elevation of a multiple compartment bag that is a first embodiment of the invention, the bag containing in a first compartment a larger flat item, and in a second compartment a smaller but relatively bulky item.
Figure 2:
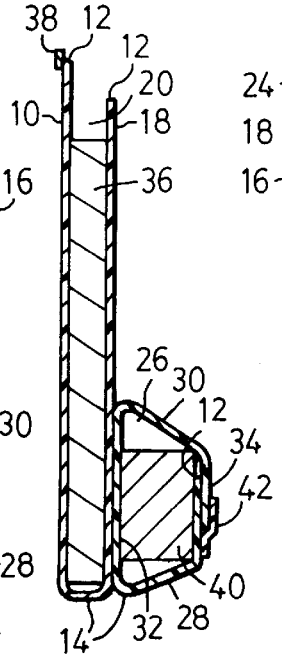
FIG. 2 is a cross section through the bag of FIG. 1 taken on the line 2—2 in that Figure.

Referring now to FIGS. 1 and 2, a two compartment bag that is a first embodiment of the invention comprises a first rectangular backing sheet part 10 of any one of the thin plastics material usually employed in the plastics bag making industry, the sheet part having a top edge 12, a bottom edge 14 and side edges 16, and a second rectangular cover sheet part 18 also having top, bottom and side edges. To avoid multiplicity of reference numbers the corresponding edges of all of the separate sheet parts from which the bag is formed are given the same reference numbers as those of the first sheet part. In the finished bag the side edges 16 of this second sheet part register with the corresponding edges of the first sheet part, while the two sheet parts are formed by folding to a J-shape a section taken from a first continuous strip of plastics material, the common fold junction between them comprising their bottom edges 14. The side edges 16 of these two sheet parts are sealed together to form a first larger compartment 20 of the two bag compartments, and in this embodiment the backing sheet part 10 is somewhat longer than the cover sheet part 18, giving a top border part 22 extending beyond the second sheet part that can be provided with wicket holes 24, and/or folded down to close the top end of the first compartment when desired. In other embodiments the section may be folded to a U-shape, whereby the two sheet parts are of the same length without such a top border part.

A second shorter compartment 26 is formed from a section of a second continuous strip of plastics material attached to the front surface of the second cover sheet part 18, this sheet section being folded along two parallel fold lines to provide a third rectangular compartment forming sheet part 28, a fourth rectangular closure sheet part 30, and a fifth rectangular connecting sheet part 32 connecting the third and fourth sheet parts. The top edges 12 of the third and fifth sheet parts comprise the common fold junction between them, while the bottom edges 14 of the fourth and fifth sheet parts are constituted by the other parallel common fold junction. The third, fourth and fifth sheet parts are all of much shorter length than the backing and cover sheet parts, while the widths of all of the first through fifth sheet parts are the same, so that all of the side edges register with one another. In this embodiment the bottom edges 14 of the second and third sheet parts register with one another. The fourth sheet part overlays a portion of the second sheet part, the top edge 12 of the third sheet part and an immediately adjacent top portion 34 of the third sheet part to an extent that will be described in detail below.

The first larger compartment 20 between the first and second sheet parts 10 and 18 extends the full length of the second sheet part and has an opening to its interior at its top end. This first compartment is made of sufficient size for a larger item 36, such as a periodical, magazine or a folded newspaper, to be received therein and the top border part 22 of the backing sheet part 10 to be folded down to close the compartment, if desired. The closure can be made more permanent, again if desired, by stapling or by a strip of adhesive tape 38 overlying the top edge of the first sheet part and the adjacent surface of the second sheet part. If the bag is made sufficiently long it is also possible to twist the upper end and tie it with a knot or with a wire tie.

The second shorter compartment 26 formed between the third through fifth sheet parts is within the area of the first compartment, this second compartment having a labyrinthine opening to its interior comprising a downward facing opening between the lower portion of the fourth sheet part 30 and the overlaid top portion 34 of the third sheet part 28, and an upward facing opening between the third and fifth sheet parts. A small but relatively bulky item 40, such as a sample box of cereal, can easily be inserted through this opening into the second compartment and will be retained securely therein by the closure formed by the overlapping two sheets, despite the fact that the opening remains permanently open for ready removal of the item by the recipient. If nevertheless a more secure closure is desired this can be achieved by use of a small piece of adhesive tape 42.

Prior proposals for comparable dual compartment bags have restricted the use of the second smaller compartment to the receipt and accommodation of a small very thin item, such as an accompanying invoice or waybill, and none provides a structure that can successfully receive and retain a bulky item therein without the necessity for a permanent closure means, such as a protected adhesive strip or a separate strip of adhesive tape. It has been found that the requirements for a successful multiple compartment bag that will safely store a bulky item in a second compartment while providing immediate permanent access, are that the compartment should extend the full width of the first compartment, thereby providing the maximum possibility of bulging outward from the first compartment while containing the bulky item, and that the labyrinthine opening should be formed as the result of overlap lengthwise between the sheet parts of closely defined limits. Specifically, the minimum lengthwise overlap required is considerable, namely at least 30% of the overall length of the second compartment, if the item is to be safely retained and readily removable as required, as compared to the 10% provided in the embodiment of the Japanese Publication No. 5-330563(A) referred to above. A maximum value for the overlap is found to be 70% of the overall length of the second compartment, since above this value there is not justifiable increase in retentiveness, and it becomes rapidly and surprisingly too difficult to readily insert and remove the bulky item, so that the additional material required is wasted. FIGS. 1 and 2 illustrate an embodiment in which the overlap to form the labyrinthine opening is at the minimum value of 30%

Such a bag can be produced using readily available sheet handling and sealing equipment and is simple and inexpensive to manufacture. In the absence of the bagged items it is sufficiently flat that it can readily be collated, stacked and packaged for transport to the place of use. Any of the outwardly facing sheet part surfaces can be provided with decorative and informative printed matter, using any of the available printing techniques for plastics materials. Even with both compartments loaded the bags are of consistent size set by the size of the first compartment, so that if desired the loaded bags can still readily be packed for transport to the distribution point. Thus, newspaper and magazine periodical publishers are able to use the bags in the field of home sample delivery using their existing distribution networks, especially since their delivery personnel are accustomed to being required to bag the newspaper prior to delivery and/or to insert into the publication additional booklets and/or advertising flyers delivered to them separately in bulk. With the multi-compartment bags of the invention it is possible for the bags, the newspapers or magazines, and the samples to be delivered separately in bulk to each delivery person, and thereafter it is not an onerous task for that person to insert the publications and the samples into the bags to result in easily carried and deliverable units. Similarly, a sample delivery organization is able to provide economically easily carried and deliverable units each consisting of a bulky sample together with any pertinent or other printed advertising material.

Although in the embodiment shown in FIGS. 1 and 2 the second compartment 26 is much smaller in length than the first compartment 20, this need not always be the case, and the length of the second compartment can be increased to a maximum when the top common junction 12 between the fourth and fifth sheet parts extends immediately adjacent to the top edge 12 of the second sheet part 18.

Figure 3:
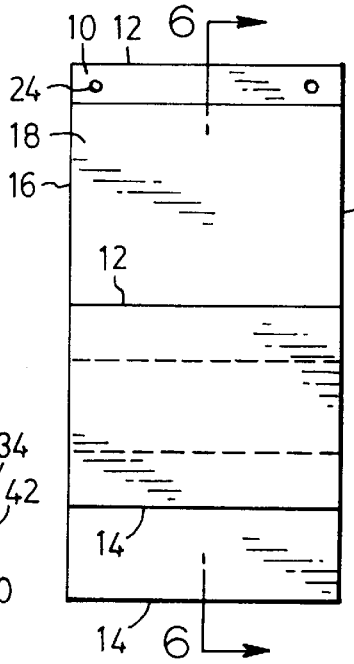
FIGS. 3 through 5 are front elevations of three other multiple compartment bags which are alternative embodiments of the invention.
Figure 6:
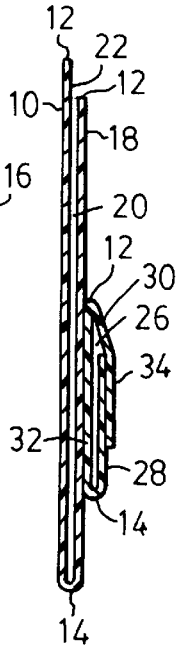
FIGS. 6 through 8 are respective cross sections through the bags of FIGS. 3 through 5, taken respectively on the lines 6—6, 7—7, and 8—8 in those Figures.

FIGS. 3 and 6 show another embodiment in which the bottom common junction 14 between the third and fifth sheet parts does not register with the bottom edges 14 of the first and second sheet parts but is spaced therefrom, the second compartment 26 therefor being located higher on the first compartment than with the embodiment of FIGS. 1 and 2. In the embodiment illustrated by these two figures the overlap between the third and fourth sheets has an intermediate value of 45%.

Figure 4:
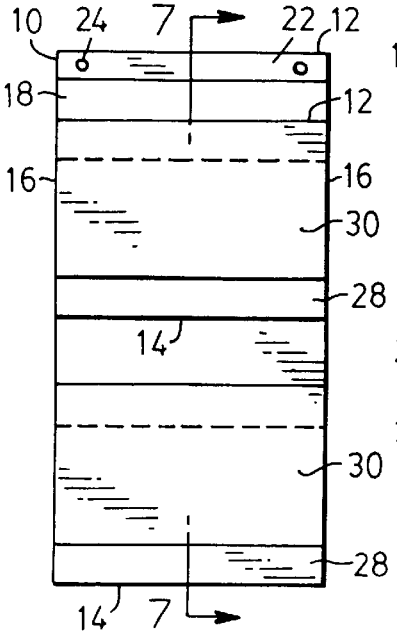
Figure 7:
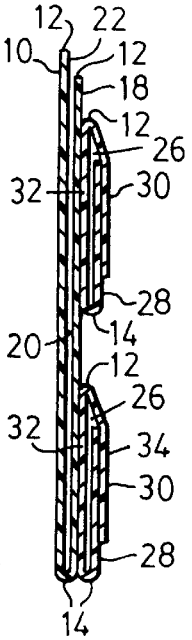

FIGS. 4 and 7 show a three-compartment bag consisting of a single first compartment 20 and two shorter sample receiving compartments 26 within the area confines of the first compartment. Two third through fifth sheet parts are provided for each bag, appropriately sealed to the second sheet part, so as to form two similar shorter additional compartments each with a labyrinthine opening formed between overlapping third and fourth sheet parts, and each of which can receive and securely retain a respective small bulky sample. In the embodiment illustrated by these two figures the overlap between the third and fourth sheets has a higher intermediate value of 55%. More than two such additional compartments can be provided if their total transverse lengths are sufficiently less than the overall length of the first compartment, and if the spacing between the additional compartments is sufficient for samples to easily inserted and removed through their respective openings.

Figure 5:
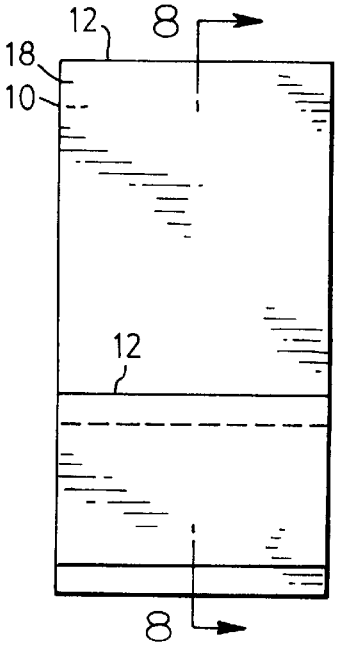
Figure 8:
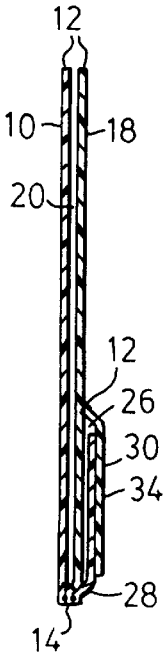

FIGS. 5 and 8 show a further embodiment in which the first through fourth sheet parts have all been provided by separate continuous sheets of the plastics material, so that no folding is required for manufacture of the bags, the sheets being laid upon one another in an appropriate sequence. The third and fourth sheet parts are sealed directly to the second sheet part and the fifth connecting sheet part 32 is not required, since its connecting function is performed by the intervening part of the second cover sheet 18. In this embodiment the first and second sheet parts are of the same length, while the overlap between the third and fourth sheets has the maximum value of 70%. In other embodiments which are not shown the first and second sheet parts may be obtained by folding a wider sheet to U-shape or to J-shape, as required, while the third and fourth sheet parts are obtained from separate sheets.

Figure 9:
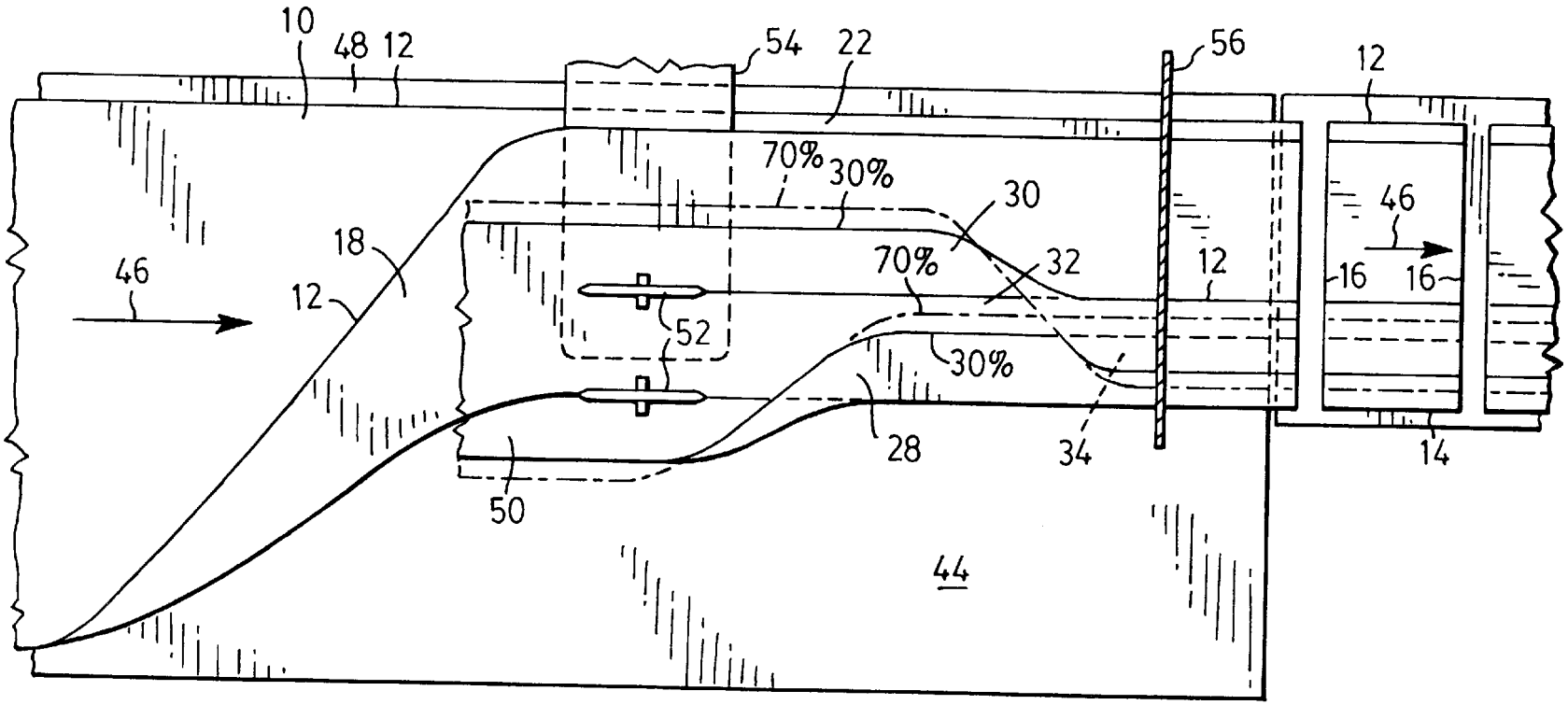
FIG. 9 is a flow diagram showing a method of making the multiple compartment bag of FIG. 1 from a plurality of continuous sheets of thin plastics material.

Referring now to the flow diagram of FIG. 9, the two compartment bag of FIGS. 1 and 2 may be manufactured by feeding onto a support surface 44, comprising the upper surface of a continuous conveyer belt moving in the direction of the arrow 46, a sheet 48 of the thin transparent plastics material. The sheet is folded by any of the folding means well known to those skilled in the art (not shown) to a J-shape in which it provides different length first and second sheets. Subsequently these sheets are divided transversely to provide respective successions of the first rectangular backing sheet parts 10 and second rectangular cover sheet parts 18 joined together along the common bottom fold junction 14. The sheets used in the manufacture of the bags will usually be supplied from respective rolls thereof (none of which are shown) and are fed onto the conveyor surface 44 by any of the well known means available in the industry for that purpose.

A second sheet 50 is fed from its roll down onto the upper surface of the succession of second sheet parts 18 and is adapted to provide upon folding along two spaced parallel fold lines (by folding means which are not shown) respective successions of third, fourth and fifth sheet parts forming a respective succession of second compartments. Prior to the folding of the second sheet 50 it is heat sealed at a sealing station to the second cover sheet parts along two spaced parallel seal lines by respective transversely spaced heated sealing wheels 52, the upper seal line also establishing the common junction between the fourth and fifth sheet parts 30 and 32, while the lower seal line also establishes the common junction between the third and fifth sheet parts 28 and 32. In this embodiment the lower common junction registers with the common junction between the first and second sheet parts, so that the bottom edges of the first and second compartments register with one another. Also in this embodiment, because of the prior folding of the first sheet 48, a shield plate 54 is interposed between the sheet parts 10 and 18 to prevent them from being sealed together along the upper seal line by the respective heated sealing wheel 52.

The sheet 50 shown in solid lines is of transverse width such that when folded as illustrated the overlap between the resulting third and fourth sheet parts is of the minimum value of 30% of the overall length of the second compartment, while the sheet 50 shown in chain broken lines is of transverse width such that when similarly folded the overlap between the resulting third and fourth sheet parts is of the maximum value of 70% of the overall length of the second compartment.

Although in this embodiment two spaced heat seal lines are employed to fasten the two sheets together, and thereby fasten the second compartment to the first compartment, in other embodiments only a single such fastening line, or more than two such fastening lines may be employed, as long as it or they are adequate to provide a secure connection between the superimposed butting sheet parts. Fastening methods known in the industry other than heat sealing may instead be employed, such as the use of hot glue or double sided tapes.

The superimposed folded and sealed together first and second sheets then pass to a sealing and severing station at which the registering side edges 16 of all of the sheet parts are simultaneously heat sealed together by the action of a heat sealing bar 56 extending transversely of the moving sheets, this single edge sealing operation being all that is required to securely establish all of the first compartment and the second compartment or compartments. At the same time the thus formed separate bags are partially or completely separated from one another by cutting through the middle of the transverse seal line produced by the bar 56; any partial separation is such as to enable the bags to be readily separated later as required. Whether completely or partially separated the bags will thereafter usually be collated, stacked and packaged for transport to the point of eventual use.

In another method which is not illustrated the second sheet 50 is sealed to the first sheet 48 prior to folding the latter, thus avoiding the need for the intervening plate 54. Any of the first through fourth sheet parts can be supplied as separate sheets from respective rolls thereof, but folding from a wider sheet is usually preferred whenever this is possible, the ease of handling compensating for the slight wastage of material caused by the presence of the fifth connecting sheet part 32, whose function is otherwise provided by the intervening part of the second sheet part.

The inexpensive thin plastic sheets required for low cost items such as the bags of the invention are almost universally produced by blow molding that results in a continuous tube of the material, and two rows of bags can be produced simultaneously from such a tube by slitting it longitudinally into two parallel sheets of the U-shape or J-shape required for the first and second sheet parts. Similarly each of the one or more second compartments can be formed from a respective smaller diameter tube that is slit longitudinally and then folded as described above.

I claim:

1. A multiple compartment bag comprising:

a first backing sheet part having top, bottom and side edges;

a second cover sheet part having top, bottom and side edges overlying the first sheet part with its bottom and side edges registering with the corresponding bottom and side edges of the first sheet part;

a third compartment forming sheet part having top, bottom and side edges, of shorter length than the second sheet part, and overlying the second sheet part, with its side edges registering with the corresponding side edges of the second sheet part;

a fourth closure sheet part having top, bottom and side edges, of shorter length than the second sheet part, overlying the second sheet part and overlying to a substantial depth the top edge and an immediately adjacent top portion of the third sheet part, with its side edges registering with the corresponding side edges of the second and third sheet parts;

a fifth connecting sheet part having top, bottom and side edges and of shorter length than the second sheet part, connected at its top and bottom edges to the third and fourth sheet parts to connect the two parts together, and extending parallel to the adjacent portion of the second sheet part with its side edges registering with the corresponding side edges of the second, third and fourth sheet parts;

all of the registering side edges being sealed together to form a first compartment for reception and retention of a relatively large flat first article between the first and second sheet parts having an opening to its interior at its top end, and to form a second compartment for reception and retention of a relatively smaller bulky second article between the third, fourth and fifth sheet parts, the second compartment having a labyrinthine opening for insertion of the second article into its interior between the fourth sheet part bottom edge and the overlaid third sheet part top edge portion;

and wherein the length of the immediately adjacent top portion of the third sheet part overlaid by the fourth closure sheet part is between 30% and 70% of the total length of the second compartment, whereby the labyrinthine opening remains sufficiently closed to retain the bulky second article in the second compartment with extensive bulging of the second compartment by the article therein.

2. A bag as claimed in claim 1, wherein the bottom edges of the first and second compartments register with one another.

3. A bag as claimed in claim 1, wherein the first and second sheet parts have been formed by folding from a respective first single sheet of thin plastics material.

4. A bag as claimed in claim 1, wherein the third through fifth sheet parts have been formed by folding from a respective second single sheet of thin plastics material.

5. A bag as claimed in claim 1, wherein the first and second sheet parts have been formed by folding from a respective first single sheet of thin plastics material, and the third through fifth sheet parts have been formed by folding from a respective second single sheet of thin plastics material.

6. A bag as claimed in claim 1 comprising:

at least two third compartment forming sheet parts of total length shorter than the length of the second sheet part and overlying the second sheet part, with their side edges registering with the corresponding edges of the first and second sheet parts;

at least two fourth closure sheet parts of total length shorter than the length of the cover sheet part, overlying the second sheet part and overlying to a substantial depth the top edge and an immediately adjacent top portion of the respective third sheet part, with their side edges registering with the corresponding side edges of the first, second and third sheet parts;

at least two fifth connecting sheet parts each connecting a respective third compartment forming sheet part and a respective fourth closure sheet part, each fifth connecting sheet part extending parallel to the adjacent portion of the second sheet part and having its side edges registering with and sealed to the corresponding side edges of the first and second sheet parts and of the respective third and fourth sheet parts;

the bag thereby comprising at least two second compartments, each for reception and retention of a relatively smaller bulky second article and each formed between the respective third, fourth and fifth sheet parts, each second compartment having a respective labyrinthine opening for insertion of the respective second article into its interior between the respective fourth sheet part bottom edge and the overlaid third sheet part top edge portion, the said substantial depth to which each fourth sheet part overlies the respective third sheet part being such that the length of the immediately adjacent top portion of the respective third sheet part overlaid by the respective fourth closure sheet part is between 30% and 70% of the length of the respective second compartment, whereby each labyrinthine opening remains sufficiently closed to retain the respective bulky second article in its second compartment with extensive bulging of the second compartment by the article therein.

7. A bag as claimed in claim 6, wherein the first and second sheet parts have been formed by folding from a respective first single sheet of thin plastics material, and each set of connected third through fifth sheet parts have been formed by folding from a respective second single sheet of thin plastics material.

8. A method of making a multiple compartment bag comprising:

providing a first backing sheet part having top, bottom and side edges and a second cover sheet part having top, bottom and side edges with the bottom and side edges of the two sheet parts registering with one another;

providing a third compartment forming sheet part having top, bottom and side edges, of shorter length than the second sheet part, and overlying the second sheet part, with its side edges registering with the corresponding edges of the second sheet part, a fourth closure sheet part having top, bottom and side edges, of shorter length than the cover sheet part, overlying the second sheet part and overlying to a substantial depth the top edge and an immediately adjacent top portion of the third sheet part, with its side edges registering with the corresponding edges of the second and third sheet parts, and a fifth connecting sheet part having top, bottom and side edges and of shorter length than the second sheet part, connected at its top and bottom edges to the third and fourth sheet parts to connect the two parts together, and extending parallel to the adjacent portion of the second sheet part with its side edges registering with the corresponding edges of the second, third and fourth sheet parts; and sealing together all of the registering side edges, thereby forming a first compartment for reception and retention of a relatively large flat first article between the first and second sheet parts which has an opening to its interior at its top end, and a second compartment for reception and retention of a relatively smaller bulky second article between the third, fourth and fifth sheet parts, the second compartment having a labyrinthine opening for insertion of the second article into its interior between the fourth sheet part bottom edge and the overlaid third sheet part top edge portion;

wherein the length of the immediately adjacent top portion of the third sheet part overlaid by the fourth closure sheet part is between 30% and 70% of the total length of the second compartment, whereby the labyrinthine opening remains sufficiently closed to retain the bulky second article in the second compartment with extensive bulging of the second compartment by the article therein.

9. A method as claimed in claim 8, wherein the sheets comprise continuous strips and separate multiple compartment bags are severed from the overlaid strips subsequent to the sealing of the sheet part edges.

10. A method as claimed in claim 8, wherein the bottom edge of each third sheet part registers with the bottom edge of the respective second sheet part, so that the bottom edges of the first and second compartments register with one another.

11. A method as claimed in claim 8, wherein the first and second sheet parts are formed by folding from a respective first single sheet of thin plastics material.

12. A method as claimed in claim 8, wherein the third through fifth sheet parts are formed by folding from a respective second single sheet of thin plastics material.

13. A method as claimed in claim 8, wherein the first and second sheet parts are formed by folding from a respective first single sheet of thin plastics material, and the third through fifth sheet parts are formed by folding from a respective second single sheet of thin plastics material.

14. A method as claimed in claim 8, and comprising:

at least two second sheets each adapted to provide respective third compartment forming sheet parts of total length shorter than the length of the second sheet part, and overlying the second sheet part, with their side edges registering with the corresponding edges of the second sheet part, each adapted to provide a respective fourth closure sheet part of total length shorter than the length of the cover sheet part, overlying to a substantial extent the second sheet part and overlying the top edge and an immediately adjacent top portion of the third sheet part, with their side edges registering with the corresponding edges of the second and third sheet parts, and each adapted to provide a fifth connecting sheet part extending parallel to the adjacent portion of the second sheet part, connecting the respective third and fourth sheet parts and with its side edges registering with the corresponding edges of the second, third and fourth sheet parts;

wherein each set of third through fifth sheet parts is formed by folding from a respective second single sheet of thin plastics material;

the method thereby providing at least two second compartments for the reception and retention of respective relatively smaller bulky second articles between the respective set of connected third, fourth and fifth sheet parts, each second compartment having a respective labyrinthine opening for insertion of the respective second article into its interior between the respective fourth sheet part bottom edge and the overlaid third sheet part top edge portion, the said substantial depth to which each fourth sheet part overlies the respective third sheet part being such that the length of the immediately adjacent top portion of the respective third sheet part overlaid by the respective fourth closure sheet part is between 30% and 70% of the length of the respective second compartment, whereby each labyrinthine opening remains sufficiently closed to retain the respective bulky second article in its second compartment with extensive bulging of the second compartment by the article therein.

* * * * *